US009708921B2

(12) United States Patent
Ahn

(10) Patent No.: US 9,708,921 B2
(45) Date of Patent: Jul. 18, 2017

(54) IMPELLER WITH SEALING PORTION

(71) Applicant: HANWHA TECHWIN CO., LTD., Changwon-si (KR)

(72) Inventor: Jong-Kee Ahn, Changwon (KR)

(73) Assignee: Hanwha Techwin Co., Ltd., Changwon-si (KR)

( * ) Notice: Subject to any disclaimer, the term of this patent is extended or adjusted under 35 U.S.C. 154(b) by 704 days.

(21) Appl. No.: 14/084,787

(22) Filed: Nov. 20, 2013

(65) Prior Publication Data

US 2014/0154078 A1 Jun. 5, 2014

(30) Foreign Application Priority Data

Nov. 30, 2012 (KR) ..... 10-2012-0138517

(51) Int. Cl.

| | |
|---|---|
| ***F01D 11/00*** | (2006.01) |
| ***F01D 1/02*** | (2006.01) |
| ***F01D 1/32*** | (2006.01) |
| ***F01D 5/02*** | (2006.01) |
| ***F04D 29/16*** | (2006.01) |

(52) U.S. Cl.

CPC ..... *F01D 11/00* (2013.01); *F01D 1/023* (2013.01); *F01D 1/32* (2013.01); *F01D 5/021* (2013.01); *F04D 29/162* (2013.01)

(58) Field of Classification Search

CPC . F01D 11/00; F01D 1/32; F01D 5/021; F01D 1/023; F04D 29/162

See application file for complete search history.

(56) References Cited

U.S. PATENT DOCUMENTS

| | | | | |
|---|---|---|---|---|
| 3,239,193 | A * | 3/1966 | Kerensky | F03B 11/006 415/1 |
| 3,966,351 | A * | 6/1976 | Sproule | F01D 11/04 415/110 |
| 5,352,089 | A * | 10/1994 | Tokunaga | B60H 1/00471 415/119 |
| 7,244,099 | B2 * | 7/2007 | Yamasaki | F04D 29/162 415/173.6 |
| 7,775,763 | B1 | 8/2010 | Johnson et al. | |
| 7,883,312 | B2 * | 2/2011 | Eguchi | F04D 29/162 415/119 |
| 8,192,165 | B2 * | 6/2012 | Higashida | F04D 29/162 416/187 |
| 9,086,073 | B2 * | 7/2015 | Iyer | F04D 25/08 |
| 2006/0198729 | A1 * | 9/2006 | Yamasaki | F04D 29/162 415/206 |

(Continued)

FOREIGN PATENT DOCUMENTS

| | | | |
|---|---|---|---|
| JP | 09177694 | A | 7/1997 |
| KR | 1020100115362 | A | 10/2010 |

*Primary Examiner* — Craig Kim
*Assistant Examiner* — Eldon Brockman
(74) *Attorney, Agent, or Firm* — Sughrue Mion PLLC

(57) ABSTRACT

There is provided an impeller rotating about a rotary shaft, the impeller including: an inlet through which a fluid is introduced; an outlet through which the fluid is discharged; a supporter connected to the rotary shaft; a blade portion provided on the supporter; a shroud portion disposed to cover the blade portion; and a sealing portion including at least one sealing protrusion protruding in a direction that is in parallel with the rotary shaft, and disposed at a portion of the shroud portion, which configures the inlet.

14 Claims, 3 Drawing Sheets

(56) References Cited

U.S. PATENT DOCUMENTS

| | | | | |
|---|---|---|---|---|
| 2007/0201976 | A1* | 8/2007 | Higashida | F04D 29/162 415/206 |
| 2008/0279681 | A1* | 11/2008 | Eguchi | F04D 29/162 415/206 |
| 2010/0284796 | A1 | 11/2010 | Mitsuda et al. | |
| 2013/0164119 | A1* | 6/2013 | Nakaniwa | F04D 29/162 415/173.1 |
| 2013/0209245 | A1* | 8/2013 | Iyer | F04D 25/08 415/206 |

* cited by examiner

IMPELLER WITH SEALING PORTION

CROSS-REFERENCE TO RELATED PATENT APPLICATIONS

This application claims priority from Korean Patent Application No. 10-2012-0138517, filed on Nov. 30, 2012, in the Korean Intellectual Property Office, the disclosure of which is incorporated herein in its entirety by reference.

BACKGROUND

1. Field

Apparatuses consistent with exemplary embodiments relate to an impeller of a rotary machine.

2. Description of the Related Art

A compressor for compressing fluid or a pump generally includes an impeller that rotates therein.

An impeller is configured to transfer a rotational kinetic energy to the fluid to increase a pressure of the fluid, and to do this, the impeller includes a plurality of blades for enabling the fluid to move and transferring the energy to the fluid.

In addition, a shroud is disposed on an outer portion of the impeller, and the shroud forms a transfer path of the fluid with the blade.

In general, since efficiency of the compressor is improved as a gap between the blades and the shroud is reduced, a technology of combining the shroud with the impeller to increase the efficiency of the compressor has been suggested as disclosed in Korean Laid-open Patent Publication No. 1996-0023833.

SUMMARY

One or more embodiments provide an impeller having excellent sealing performance.

According to an aspect of an exemplary embodiment, there is provided an impeller rotating about a rotary shaft, the impeller including: an inlet through which a fluid is introduced; an outlet through which the fluid is discharged; a supporter connected to the rotary shaft; a blade portion provided on the supporter; a shroud portion disposed to cover the blade portion; and a sealing portion including at least one sealing protrusion protruding in a direction that is in parallel with the rotary shaft, and disposed at a portion of the shroud portion, which configures the inlet.

The impeller may be provided in a compressor or a pump.

The sealing protrusion may be disposed above a topmost portion of the supporter where the inlet is disposed.

A bonding portion, where the sealing portion and the shroud portion are bonded to each other, may be disposed above the topmost portion of the supporter where the inlet is disposed.

The sealing portion may have a ring shape.

BRIEF DESCRIPTION OF THE DRAWINGS

These and/or other aspects will become apparent and more readily appreciated from the following description of the embodiments, taken in conjunction with the accompanying drawings, in which.

DETAILED DESCRIPTION OF THE EXEMPLARY EMBODIMENTS

Figure 1:
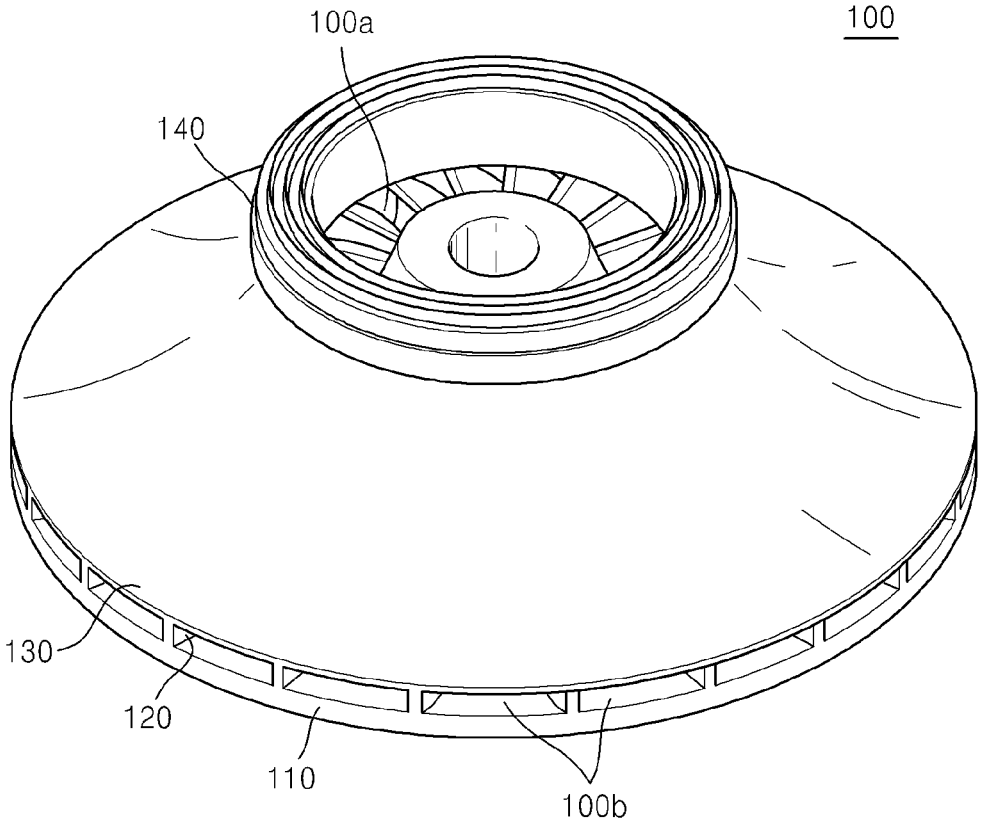
FIG. 1 is a schematic perspective view of an impeller according to an exemplary embodiment.

Reference will now be made in detail to exemplary embodiments, which are illustrated in the accompanying drawings, wherein like reference numerals refer to the like elements throughout. In this regard, the present embodiments may have different forms and should not be construed as being limited to the descriptions set forth herein. Accordingly, the embodiments are merely described below, by referring to the figures, to explain aspects of the present description.

Figure 2:
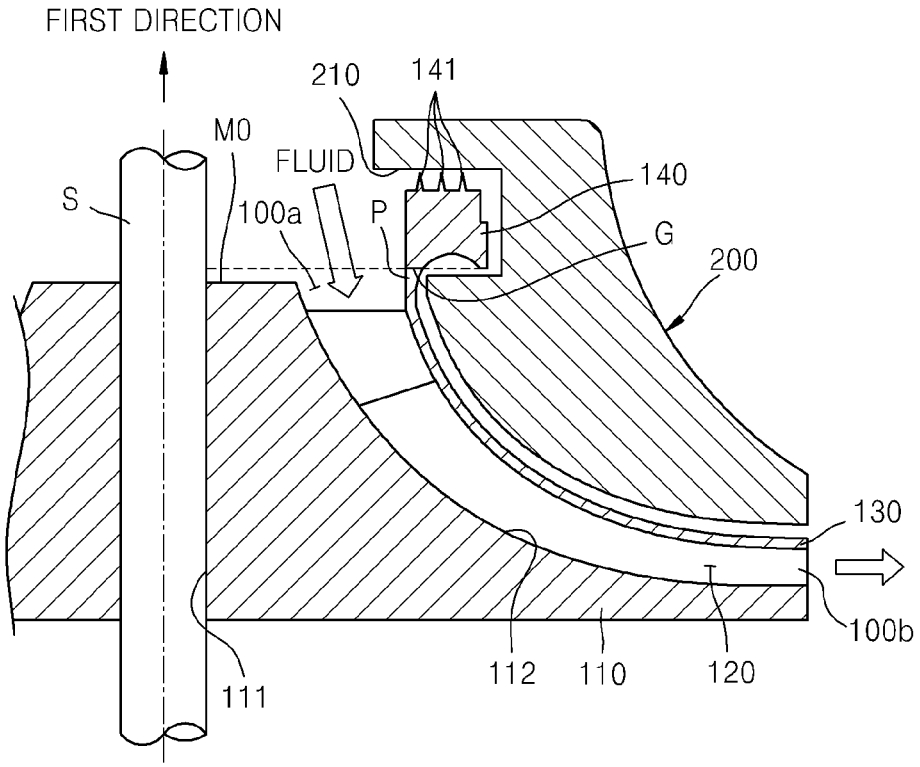
FIG. 2 is a partial cross-sectional view schematically showing an impeller provided in a casing of a compressor according to an exemplary embodiment.
Figure 3:
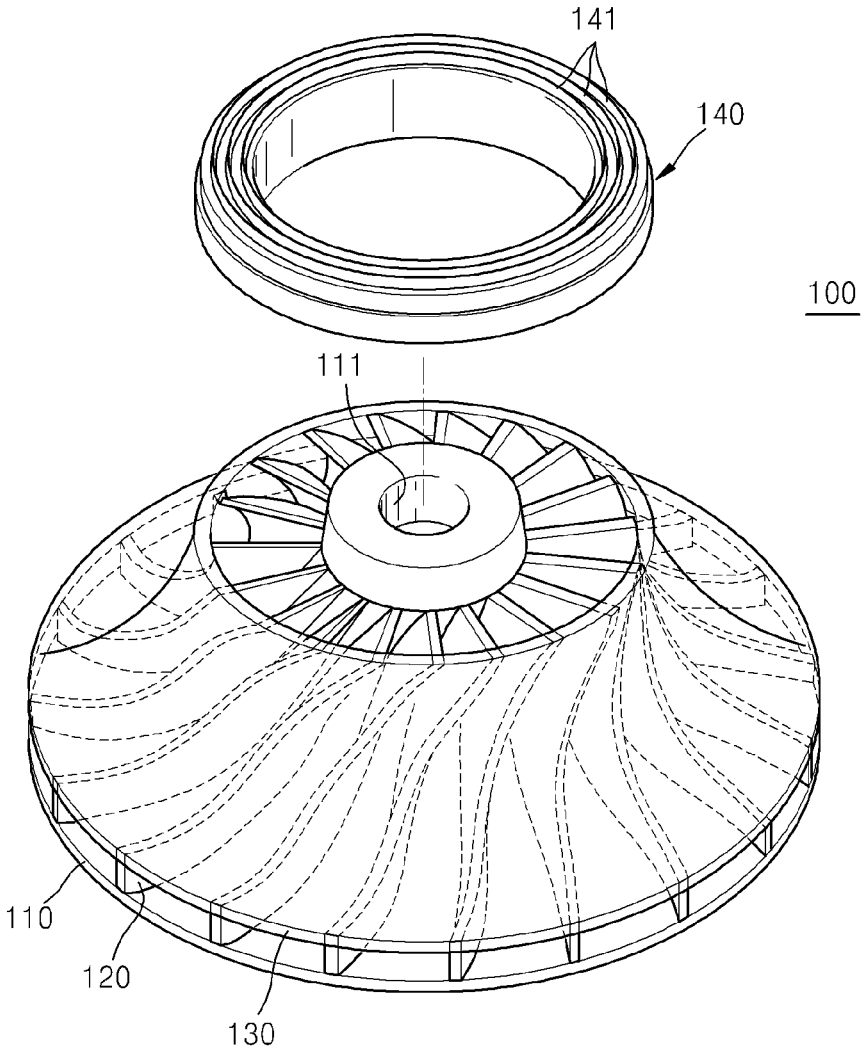
FIG. 3 is an exploded perspective view schematically showing a sealing portion separated from a shroud portion in an impeller according to an exemplary embodiment.

FIG. 1 is a schematic perspective view of an impeller 100 according to an exemplary embodiment, FIG. 2 is a partial cross-sectional view schematically showing an impeller provided in a casing of a compressor according to an exemplary embodiment, and FIG. 3 is an exploded perspective view schematically showing a sealing portion separated from a shroud portion in an impeller according to an exemplary embodiment.

As shown in FIGS. 1 through 3, the impeller 100 is provided in a compressor (not shown), and the impeller 100 includes an inlet 100*a*, an outlet 100*b*, a supporter 110, a blade portion 120, a shroud portion 130, and a sealing portion 140.

The inlet 100*a* is a portion through which a fluid is introduced, and the outlet 100*b* is a portion through which the introduced fluid is discharged. The introduced fluid may be discharged through the outlet 100*b* after receiving energy.

In addition, the supporter 110 has a conical shape having a gradual inclination, and a mounting hole 111 is formed in a center portion of the supporter 110. The supporter 110 is connected to a rotary shaft S which is inserted in the mounting hole 111, The rotary shaft S may be inserted in the mounting hole 111 during an installation process of the impeller 100.

A surface 112 of the supporter 110 is formed to configure a slanted curved surface that becomes a bottom surface of a fluid passage, so that the fluid may flow softly and the energy may be transferred to the fluid with the highest efficiency.

The blade portion 120 is provided on the surface 112 of the supporter 110, and the blade portion 120 guides movement of the fluid and transfers a kinetic energy of the impeller 100 to the fluid.

The shroud portion 130 is formed as an umbrella with an open center portion so as to be bonded to an upper portion of the blade portion 120 to cover the upper portion of the blade portion 120.

Here, the shroud portion 130 may be bonded to the blade portion 120 by an electron beam welding method or a laser beam welding method. In particular, a manufacturer makes the shroud portion 130 contact a surface of the blade portion 120, and then, irradiates an electron beam or a laser beam to an outer surface of the shroud portion 130 to form a melting portion and coagulate the melting portion, thereby forming a welded junction.

An inner surface of the shroud portion 130 forms a ceiling surface of the fluid passage, and forms the transfer path of the fluid with the surface 112 of the supporter 110 and the blade portion 120.

In addition, as shown in FIGS. 2 and 3, the sealing portion 140 has a ring shape, and is disposed at a portion P of the shroud portion 130, which configures the inlet 100*a*.

The sealing portion 140 is bonded to the portion P of the shroud portion 130, which configures the inlet 100*a*, by using various bonding methods, for example, a welding method. For example, the manufacturer prepares a structure in which the shroud portion 130 is bonded to the blade portion 120, and may bond the sealing portion 140 to the shroud portion 130 by using an arc welding, a gas welding, an electron beam welding, or a laser welding after contacting the portion P of the shroud portion 130 to the sealing portion 140.

The sealing portion 140 includes at least one sealing protrusion 141 that protrudes in a direction that is in parallel with a shaft direction of a rotary shaft S, and the at least one sealing protrusion 141 performs a sealing operation with a sealing surface 210 of a casing 200 so as to prevent the fluid from flowing backward. If the fluid flows backward, it may flow along the outer surface of the shroud portion 130.

In particular, as shown in FIG. 2, when it is assumed that a direction from the bottom to the top of the supporter 110 is a first direction, the sealing protrusion 141 is configured to be located beyond or above the outermost or topmost portion MO of the supporter 110 in the first direction. According to the above configuration, the sealing portion 140 itself may protrude toward the first direction, and then, the sealing portion 140 may be easily bonded to the shroud portion 130, thereby reducing manufacturing costs. In particular, if a junction G between the sealing portion 140 and the shroud portion 130 is configured to locate beyond or above the outermost or topmost portion MO of the supporter 110 in the first direction, the sealing portion 140 may be easily bonded to the shroud portion 130, thereby reducing the manufacturing costs.

Moreover, like in the present embodiment, if the sealing portion 140 is disposed to protrude toward the first direction, an increase in a moment of inertia may be reduced more effectively than a case where the sealing portion is disposed to protrude in a radial direction of the rotary shaft S. As such, even if the impeller 100 rotates at high speed, an inertial force may be reduced and the impeller 100 may rotate stably.

Hereinafter, processes of transferring energy to the fluid introduced into the impeller 100 by rotating the impeller 100 will be described.

When the rotary shaft S rotates by a driving power from a driver (not shown) of a compressor, the impeller 100 rotates.

As denoted by an arrow in FIG. 2, the fluid is introduced into the inlet 100*a* of the impeller 100, and then, the fluid receives a rotating kinetic energy of the impeller 100 and is discharged out of the outlet 100*b* with a high pressure. After that, the fluid reduces a velocity to increase the pressure to a desired level while passing through a diffuser (not shown), and detailed descriptions thereof are not provided here.

Meanwhile, the sealing portion 140 performs a sealing operation with the sealing surface 210 in the casing 200 in a direction that is in parallel with the rotary shaft S, and thus, backflow of the fluid that is discharged through the outlet 100*b* toward the inlet 100*a* during the operation of the impeller 100 is prevented.

According to the impeller 100 of the present embodiment, the effective sealing operation may be realized by forming the sealing portion 140 including the sealing protrusion 141 that protrudes in parallel with the shaft direction of the rotary shaft S.

Also, in the impeller 100 of the present embodiment, the sealing protrusion 141 is located beyond or above the outermost or topmost portion MO of the supporter 110 in the first direction, and thus, the sealing portion 140 protrudes toward the first direction. As such, the sealing portion 140 may be easily bonded to the shroud portion 130, and the manufacturing costs may be reduced. In particular, if the junction G between the sealing portion 140 and the shroud portion 130 is configured to locate beyond or above the outermost or topmost portion MO of the supporter 110 in the first direction, the sealing portion 140 may be easily bonded to the shroud portion 130, thereby reducing the manufacturing costs.

Also, when the sealing portion 140 is disposed to protrude in the first direction, the increase in the moment of inertia caused by the sealing portion 140 may be reduced effectively. Then, even if the impeller 100 rotates at high speed, the impeller 100 may rotate stably.

In addition, the impeller 100 according to the exemplary embodiment is applied to the compressor; however, the exemplary embodiment is not limited thereto. That is, the impeller according to an exemplary embodiment may be applied to any kind of rotating machine, provided that a pressure and a velocity of the fluid may be changed by the rotation of the impeller, for example, a pump or an air blower.

As described above, according to the one or more of the above exemplary embodiment, the impeller having an excellent sealing property may be obtained.

Also, the manufacturing costs of the impeller may be reduced because the bonding of the sealing portion may be easily performed.

It should be understood that the exemplary embodiments described therein should be considered in a descriptive sense only and not for purposes of limitation. Descriptions of features or aspects within each embodiment should typically be considered as available for other similar features or aspects in other embodiments. For example, the sealing portion 140 and the shroud portion 130 may be one single body although the above-described embodiment indicates that these two portions as two separate portions. Also, the impeller according to an exemplary embodiment may not have the sealing protrusion 141 as long as the sealing portion 140 is configured to be high enough with respect to the topmost portion MO of the supporter 110 to sufficiently prevent a backward flow of the fluid along the outer surface of the shroud portion 130.

While one or more exemplary embodiments have been described with reference to the figures, it will be understood by those of ordinary skill in the art that various changes in form and details may be made therein without departing from the spirit and scope of the inventive concept as defined by the following claims.

What is claimed is:

1. An impeller rotating about a rotary shaft, the impeller comprising:

an inlet through which a fluid is introduced;

an outlet through which the fluid is discharged;

a supporter connected to the rotary shaft;

a blade portion provided on the supporter;

a shroud disposed to cover the blade portion; and a seal including at least one sealing protrusion protruding in an axial direction of the rotary shaft, the seal being coupled to the shroud at an outermost end of the shroud along the axial direction thereby forming a junction between the shroud and the seal, wherein a width of the seal, in a radial direction of the shaft, being measured above the junction between the seal and the shroud is greater than a width of the shroud, in the radial direction of the shaft, being measured at the junction.

2. The impeller of claim 1, wherein the impeller is provided in a compressor or a pump.

3. The impeller of claim 1, wherein the at least one sealing protrusion is disposed above a topmost portion of the supporter where the inlet is disposed.

4. The impeller of claim 3, wherein a bonding portion, where the seal and the shroud are bonded to each other, is disposed above the topmost portion of the supporter where the inlet is disposed.

5. The impeller of claim 1, wherein the seal has a ring shape.

6. The impeller of claim 1, wherein an inner-most portion of the seal along the radial direction is attached to the portion of the shroud configuring the inlet.

7. The impeller of claim 1, wherein the at least one sealing protrusion comprises a plurality of sealing protrusions.

8. The impeller of claim 7, wherein each sealing protrusion of the plurality of sealing protrusions has a ring shape.

9. An impeller rotating about a rotary shaft, the impeller comprising:

an inlet through which a fluid is introduced;

an outlet through which the fluid is discharged;

a supporter configured to rotate when the rotary shaft rotates;

a blade portion provided on the supporter;

a shroud disposed to cover the blade portion; and a seal being coupled to the shroud at an outermost end of the shroud along an axial direction, the outermost end configured the inlet along with a topmost surface of the supporter, the seal and the shroud being coupled at a junction between the seal and the shroud, wherein a topmost surface of the seal is higher than the topmost surface of the supporter, and wherein a width of the seal, in a radial direction of the shaft, being measured above the junction between the seal and the shroud is greater than a width of the shroud, in the radial direction of the shaft, being measured at the junction.

10. The impeller of claim 9, wherein the topmost surface of the seal comprises at least one sealing protrusion.

11. The impeller of claim 10, wherein the at least one sealing protrusion comprises a plurality of sealing protrusions.

12. The impeller of claim 11, wherein each sealing protrusion of the plurality of sealing protrusions has a ring shape.

13. The impeller of claim 9, wherein the shroud and the seal constitutes a single body.

14. The impeller of claim 9, wherein an inner-most portion of the seal along the radial direction is attached to the portion of the shroud configuring the inlet.

* * * * *